US008624947B2

(12) United States Patent
Takahashi et al.

(10) Patent No.: US 8,624,947 B2
(45) Date of Patent: Jan. 7, 2014

(54) PRINTER

(71) Applicant: Brother Kogyo Kabushiki Kaisha, Nagoya (JP)

(72) Inventors: Toshihiko Takahashi, Nagoya (JP); Takehiko Inaba, Nagoya (JP); Yasutoshi Kano, Nagoya (JP); Atsushi Kasugai, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/834,258

(22) Filed: Mar. 15, 2013

(65) Prior Publication Data

US 2013/0258030 A1 Oct. 3, 2013

(30) Foreign Application Priority Data

Mar. 27, 2012 (JP) ..... 2012-072583

(51) Int. Cl.
*B41J 2/32* (2006.01)

(52) U.S. Cl.
USPC ..... 347/218

(58) Field of Classification Search
USPC ..... 347/215, 218
See application file for complete search history.

(56) References Cited

U.S. PATENT DOCUMENTS 4,828,416 A 5/1989 Pensavecchia et al.
4,834,568 A * 5/1989 Kagami et al. ..... 400/707.1
5,057,860 A * 10/1991 Suzuki ..... 399/279
5,069,564 A * 12/1991 Kako et al. ..... 400/605
5,087,142 A * 2/1992 Suzuki et al. ..... 400/616
5,122,004 A * 6/1992 Yamada et al. ..... 400/616.2
5,479,199 A 12/1995 Moore et al.
6,189,990 B1 * 2/2001 Youn ..... 347/8

FOREIGN PATENT DOCUMENTS

JP 7052476 2/1995
JP 2004025512 1/2004

OTHER PUBLICATIONS

European Search Report issued in Application No. 13159476 on Jul. 25, 2013.

* cited by examiner

*Primary Examiner* — Huan Tran
(74) *Attorney, Agent, or Firm* — McCarter & English, LLP

(57) ABSTRACT

The disclosure discloses a printer includes a main-body case, a housing portion configured to house substantially sheet-shaped media to be printed as a print object therein, a pickup roller configured to pick up and feed the medium to be printed toward a first direction along a surface direction of the medium, a platen roller configured to feed the medium to be printed, a print head configured to perform desired printing on the medium to be printed being fed, a paper guide configured to reverse the medium to be printed being fed toward a second direction in opposite to the first direction, the paper guide including at least one arc-shaped surface portion provided along the outer peripheral surface of the platen roller in an opposed manner thereto, and a coupling member that couples between the paper guide and a rotation shaft of the platen roller.

4 Claims, 11 Drawing Sheets

EMBODIMENT

EMBODIMENT

COMPARATIVE EXAMPLE

EMBODIMENT

EMBODIMENT

PRINTER

CROSS-REFERENCE TO RELATED APPLICATION

The present application claims priority from Japanese Patent Application No. 2012-072583, which was filed on Mar. 27, 2012, the disclosure of which is incorporated herein by reference in its entirety.

BACKGROUND

1. Field

The present disclosure relates to a printer for performing desired printing on a medium to be printed.

2. Description of the Related Art

The technique has been known as a printer which disposes substantially sheet-shaped media to be printed within a thin box-shaped main-body case thereof, for example, and performs desired printing on the media to be printed.

This printer of the prior art includes a housing portion (sheet housing portion), a pick-up roller, and a platen roller within the main-body case. The medium to be printed housed within the housing portion is picked up by the pick-up roller and fed to the one side of the case. The medium to be printed (paper) having been fed is fed to the opposite side, that is, toward the other side of the case while being reversed by the platen roller.

At the time of reversing and feeding the medium to be printed by the platen roller, the medium to be printed is guided by a paper guide. In this respects, a circular surface portion provided at the paper guide is opposed to the platen roller so as to face along the outer peripheral surface of the platen roller. As described above, since the circular surface portion guides the medium to be printed having been fed to the one side of the case, the medium to be printed can be smoothly introduced with respect to the platen roller. Further, even after the introduction, since the circular surface portion guides the medium to be printed along the outer peripheral surface of the platen roller, the platen roller smoothly reverses and feeds the medium to be printed. A print head (thermal head) performs desired printing on the medium to be printed having been reversed and being fed to the other side of the case by the platen roller, to thereby complete a printed medium.

According to the aforesaid prior art, in order to reliably guide the medium to be printed at the time of introducing the medium to be printed to the plate roller as described above and at the time of reversing and feeding the medium to be printed by the platen roller, the paper guide is disposed in a manner that the paper guide is urged and made in contact with the outer peripheral surface of the platen roller by a spring pressure. However, in this case, since the paper guide in a still state slides on the platen roller being rotated and applies a friction force thereto, this friction force acts as a resistance force for obstructing the rotation of the platen roller. As a result, since the platen roller requires a large torque in order to smoothly rotate against the resistance force, it was difficult to increase the feeding speed.

SUMMARY

Accordingly, an object of the present disclosure is to provide a printer which can reduce the rotation resistance against the platen roller and increase the feeding speed while reliably guiding a media to be printed.

In order to achieve the above-described object, according to the aspect of the present application, there is provided a printer comprising a main-body case, a housing portion configured to house substantially sheet-shaped media to be printed as a print object therein, the housing portion being opened on one side of the main-body case, a pickup roller configured to pick up and feed the medium to be printed toward a first direction along a surface direction of the medium, the pickup roller being disposed in the housing portion, a platen roller configured to feed the medium to be printed, being fed toward the first direction by the pickup roller, the platen roller being provided on the first direction side than the pickup roller, a print head configured to perform desired printing on the medium to be printed being fed, a paper guide configured to reverse, in cooperation with the print head, the medium to be printed being fed toward a second direction in opposite to the first direction while feeding the medium to be printed being fed along an outer peripheral surface of the platen roller, the paper guide including at least one arc-shaped surface portion provided along the outer peripheral surface of the platen roller in an opposed manner thereto, and a coupling member that couples between the paper guide and a rotation shaft of the platen roller so as to keep a predetermined gap between the arc-shaped surface portion of the paper guide and the outer peripheral surface of the platen roller.

The printer according to the present disclosure includes the housing portion, the pickup roller and the platen roller within the main-body case. The medium to be printed housed within the housing portion is picked up by the pickup roller and fed to the first direction. The medium to be printed having been fed to the first direction is fed to the second direction in opposite to the first direction while being reversed by the platen roller. The paper guide guides the medium to be printed when the medium to be printed is reversed and fed by the platen roller. In this respect, the arc-shaped surface portion provided at the paper guide oppose to the platen roller so as to face along the outer peripheral surface thereof. Since the arc-shaped surface portion guide the medium to be printed having been fed to the first direction, the medium to be printed is smoothly introduced with respect to the platen roller. Further, since the arc-shaped surface portion guide the medium to be printed along the outer peripheral surface of the platen roller after introducing the medium to be printed, the platen roller can smoothly reverse and feed the medium to be printed. The print head performs desired printing on the medium to be printed having been reversed and being fed toward the second direction by the platen roller to thereby completes a printed medium.

According to the present disclosure, the paper guide is not made in contact with the outer peripheral surface of the platen roller but is disposed so as to keep the predetermined gap between the paper guide and the platen roller. To be concrete, the coupling member configured to couple between the paper guide and the rotation shaft of the platen roller is provided. The coupling member acts to keep a substantially arc-shaped predetermined gap between the arc-shaped surface portion of the paper guide and the outer peripheral surface of the platen roller. As a result, when the gap is set to a suitable small value, the friction force generated by the sliding operation between the platen roller and the paper guide can be prevented from acting as the resistance force for obstructing the rotation of the platen roller. In this case, since the feeding force toward the first direction caused by the platen roller acts on the medium to be printed, the medium to be printed proceeds the gap between the platen roller and the paper guide. Further, when the medium to be printed proceeds the substantially arc-shaped predetermined gap, the feeding force of the platen roller indirectly acts on the portion or the portion in the vicinity thereof of the substantially sheet-shaped medium to be printed. Thus, the medium to be printed can be reliably guided at the time of introducing the medium to be printed into the platen roller and reversing/feeding the medium to be printed by the platen roller.

As described above, with arrangement of the present disclosure, since the resistance force for obstructing the rotation of the platen roller can be reduced while reliably guiding the medium to be printed, the feeding speed can be increased.

DETAILED DESCRIPTION OF THE PREFERRED EMBODIMENTS

Hereinafter, an embodiments of the present disclosure will be explained with reference to drawings.

<Entire Configuration>

Figure 1:
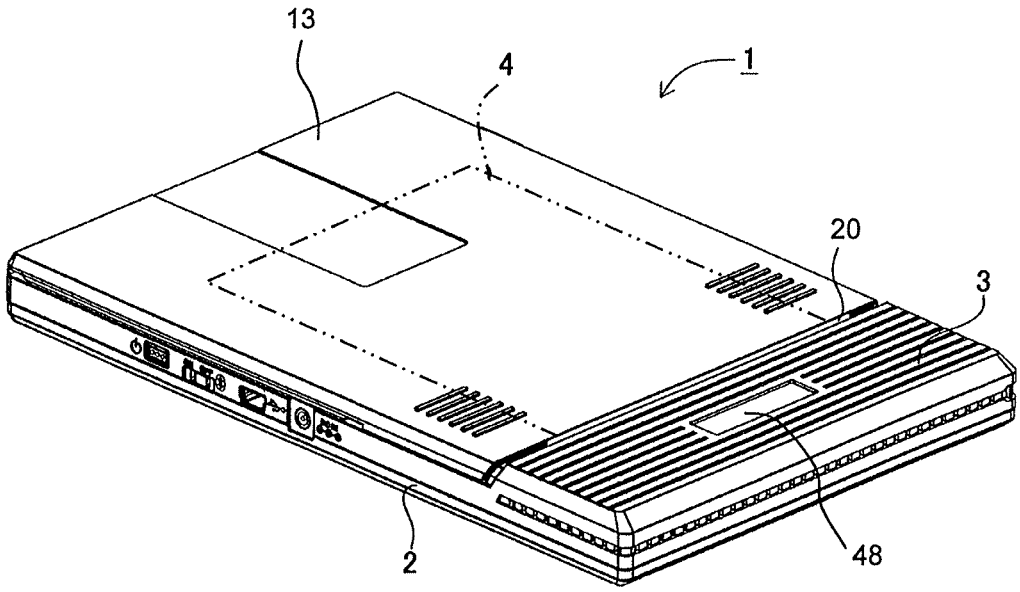
FIG. 1 is a schematic perspective diagram showing the exterior appearance of a handheld compact printer representing a printer according to an embodiment of the present disclosure.

As shown in FIG. 1, a handheld compact printer 1 according to this embodiment includes a box-shaped main-body case 2 which upper surface is opened. The main-body case 2 has an A-6 or A-7 size in its planer view and has a thickness of about 1 cm or more. On the upper surface of the main-body case 2, a fixed cover 3 and a rotatable lid 13 are juxtaposed.

Figure 2:
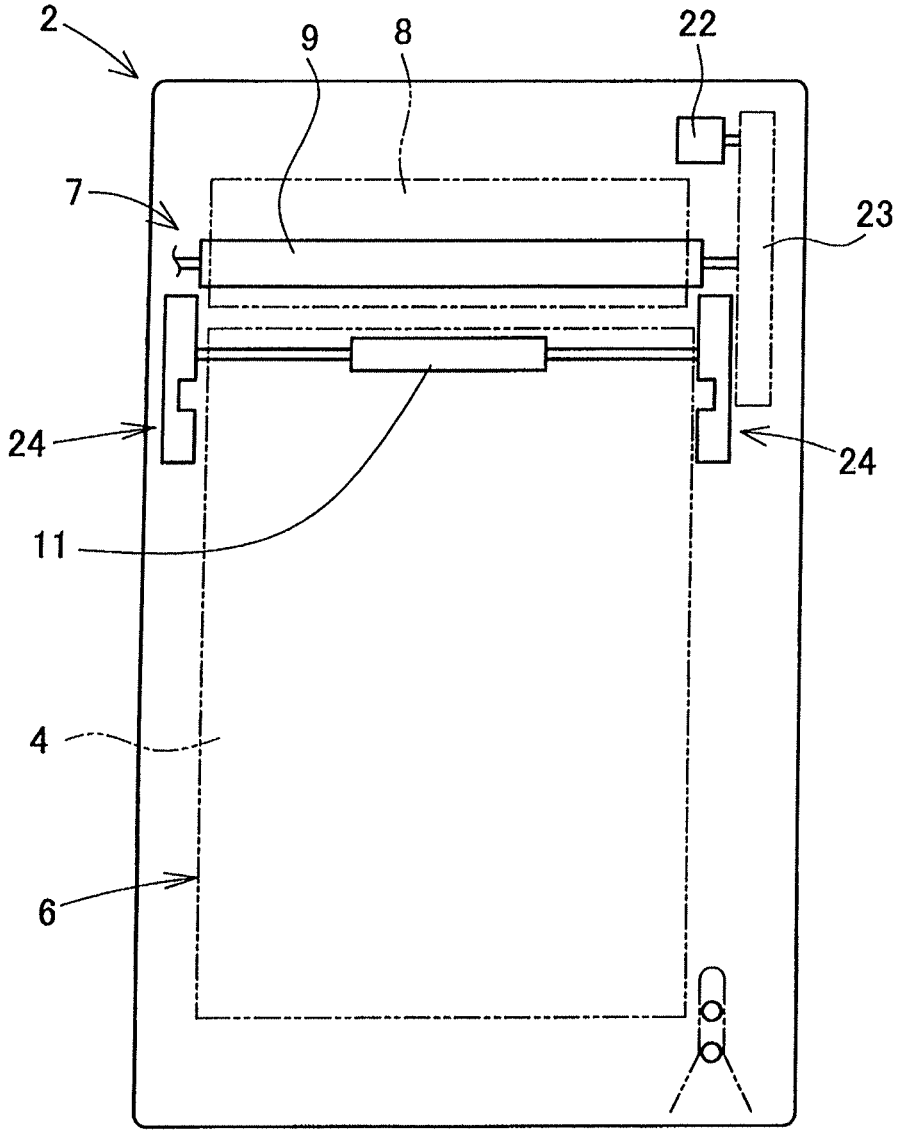
FIG. 2 is a schematic plan view of the main-body case of the handheld compact printer.
Figure 3:
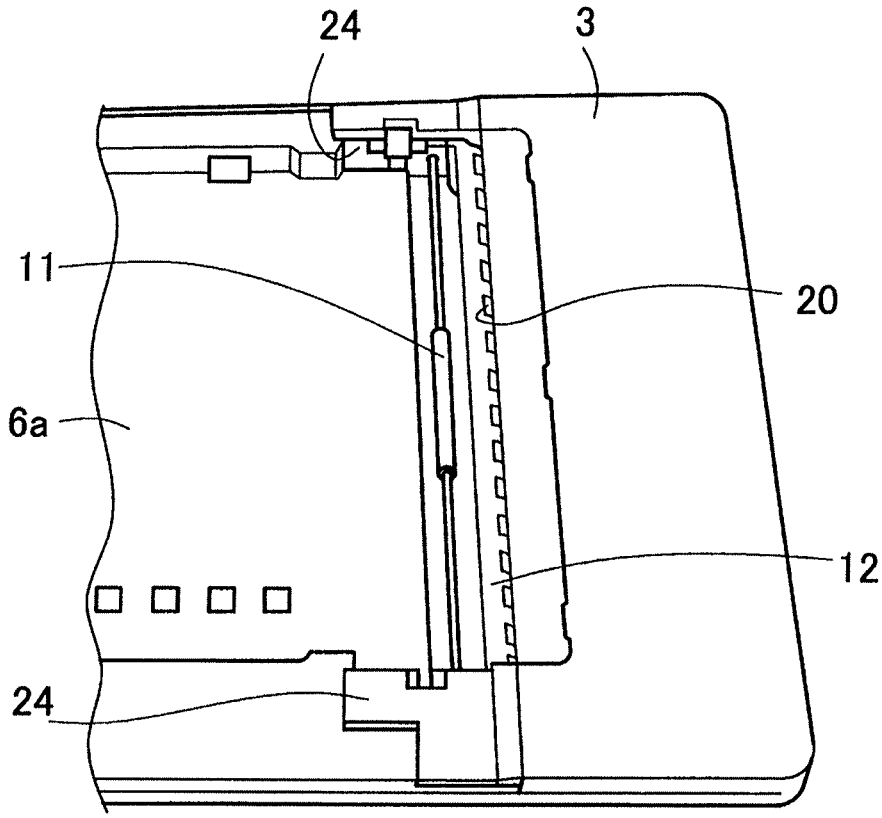
FIG. 3 is a perspective view of the pickup roller of the handheld compact printer.
Figure 4:
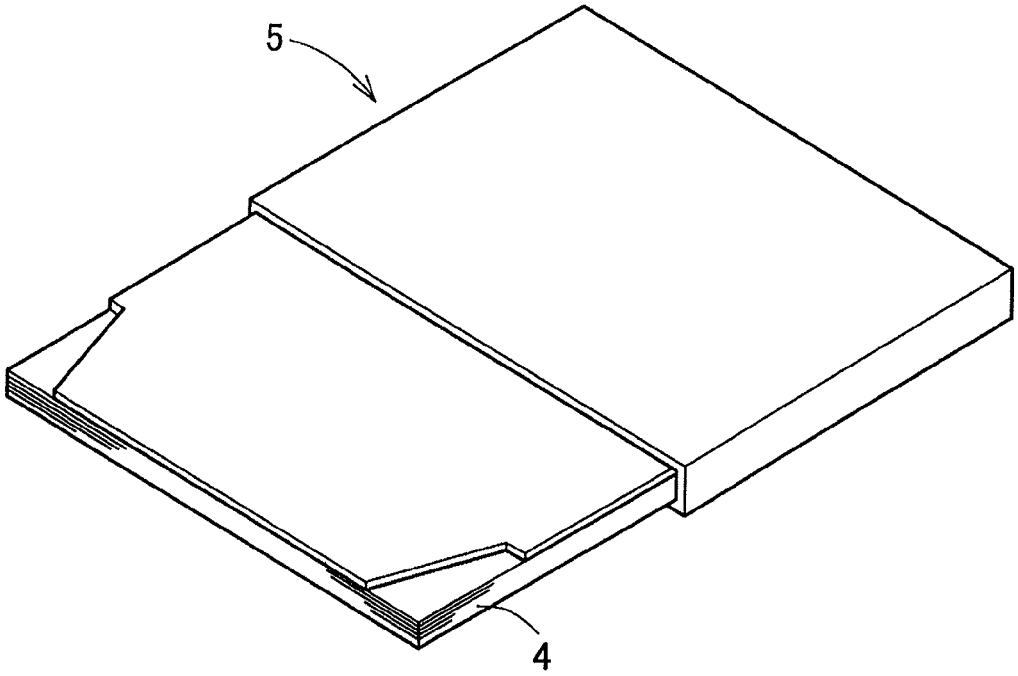
FIG. 4 is a perspective view of the sheet package of the handheld compact printer.

As shown in FIGS. 2 and 3, a sheet housing portion 6 housing a sheet package 5 (see FIG. 4) therein is formed within the main-body case 2. The sheet package houses a plurality of thermal papers 4. The sheet housing portion 6 is opened upward and the opened portion thereof is covered by the lid13. In the vicinity of the fixed cover 3 within the main-body case 2, a thermal head 8 acting as a printing mechanism portion 7, a platen roller 9, a paper guide 10 (see FIG. 5 as explained later), a pickup roller 11, a separation block 12 and so on are disposed.

Figure 5:
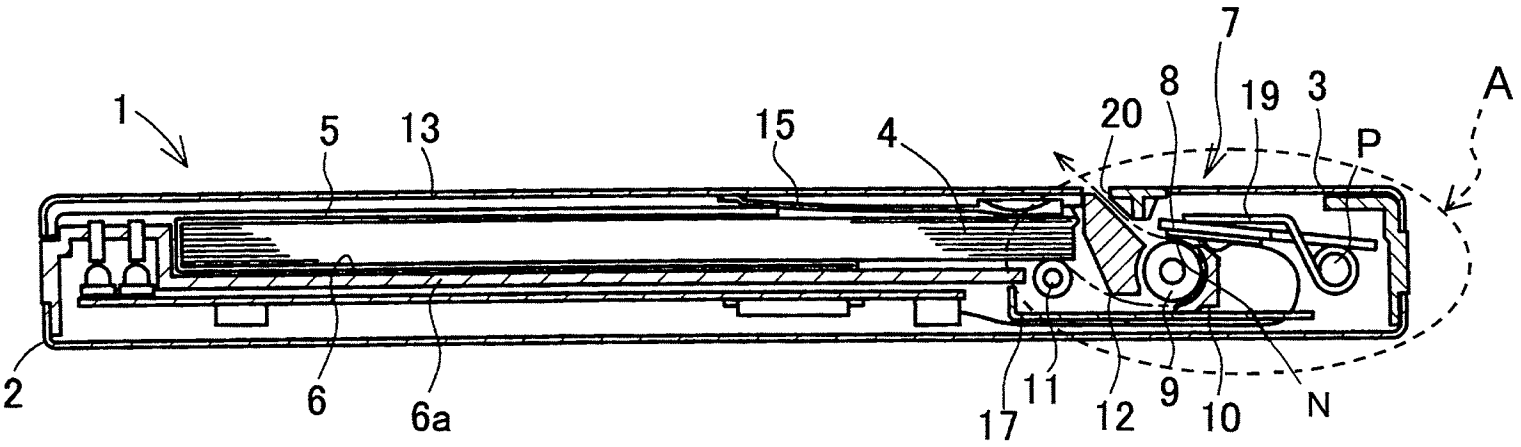
FIG. 5 is a side sectional view of the handheld compact printer.

As shown in FIG. 5, the pickup roller 11 and the separation block 12 are disposed on the side closer to the printing mechanism portion 7 in the sheet housing portion 6. The sheet package 5 housed within the sheet housing portion 6 is biased toward the bottom plate 6*a* of the sheet housing portion 6 by a biasing means 15 such as a plate spring which is provided at the inner surface side of the main body of the lid 13 in a closed state. Thus, the lowermost one of the laminated thermal papers 4 within the sheet package 5 is abutted against the pickup roller 11. As a result, when the pickup roller 11 is rotated, only the lowermost thermal paper 4 is picked up and transferred toward the first direction (right direction in FIG. 5) along the surface direction of this substantially sheet-shaped paper, and passes through a gap between the lower of the separation block 12 and a guide plate 17.

The platen roller 9 is provided in a rotatable manner in adjacent to the separation block 12 on the first direction side than the pickup roller 11. The paper guide 10, having the structure described later, is provided at the radially outer peripheral side of the platen roller 9. Only the lowermost one of the thermal papers 4 is separated from the sheet package 5 by the pickup roller 11 and the guide engagement surface (not shown) of the separation block 12 and is transferred to a gap between the platen roller 9 and the paper guide 10. The thermal paper 4 thus separated and transferred from the sheet housing portion 6 is reversed toward the second direction (left direction in FIG. 5) in opposite to the first direction while being transferred through a U-shaped path (described later in detail) formed between the outer peripheral surface of the platen roller 9 and the paper guide 10, and transferred to the printing position of the thermal head 8.

The thermal head 8 is a line-head type print head which prints characters, images etc. in a line-based manner on the thermal paper 4 which is sandwiched between the platen roller 9 and the head and transferred toward the second direction. The printing width of the head at the time of printing a single line is set to be substantially same as the width of the thermal paper 4. In this embodiment, each of the thermal head 8 and the platen roller 9 has the length substantially same as the short side of the thermal paper 4 of A6- or A7-size. The thermal head 8 is employed as the print head by the following reason. That is, by using the thermal papers 4 as the media to be printed, consumable goods such as ink and ink ribbons are not required and hence the mechanism for ink and ink ribbons can be eliminated, so that the handheld compact printer 1 can be made compact. As the thermal papers 4, various types may be used such as a thermosensitive coloring type having a coloring layer which generates color by the heating from the thermal head 8 or a thermosensitive perforation type which is formed by laminating a perforation layer being perforated by the heating on a base material.

A spring engagement portion at the tip side of a coil spring 19, which base is wound around a supporting portion P, is engaged on the rear surface (upper surface) of the thermal head 8 so as to bias the thermal head toward the platen roller 9 side. Thus, the printing portion N of the thermal head 8 abuts against the platen roller 9. The upper surface of the thermal paper 4 is printed by the thermal head 8 and the thermal paper 4 is ejected to the outside of the lid 13 from a gap 20 between the upper surface of the separation block 12 and the edge of the fixed cover 3.

<Driving Mechanism>

As shown in FIGS. 2 and 3, the driving mechanism of the platen roller 9 and the pickup roller 11 is configured by a driving motor 22 and a gear transmission mechanism (gear train) 23 each disposed at the inner surface on the one side (feeding direction of the thermal paper 4 shown in FIG. 2)

along the long side of the main-body case 2. Further, a one-way clutch (not shown) is provided on the downstream side than the platen roller 9 of the gear train. The one-way clutch makes it possible to rotate the pickup roller 11 together with the platen roller 9 with respect to the feeding at the portion of the platen roller 9. A pair of guide support blocks 24 are fixed at the inner surfaces along a pair of the long sides of the main-body case 2 so as to extend to the platen roller 9 side from the paper guide 10, respectively.

<Electrical Configuration>

Figure 6:
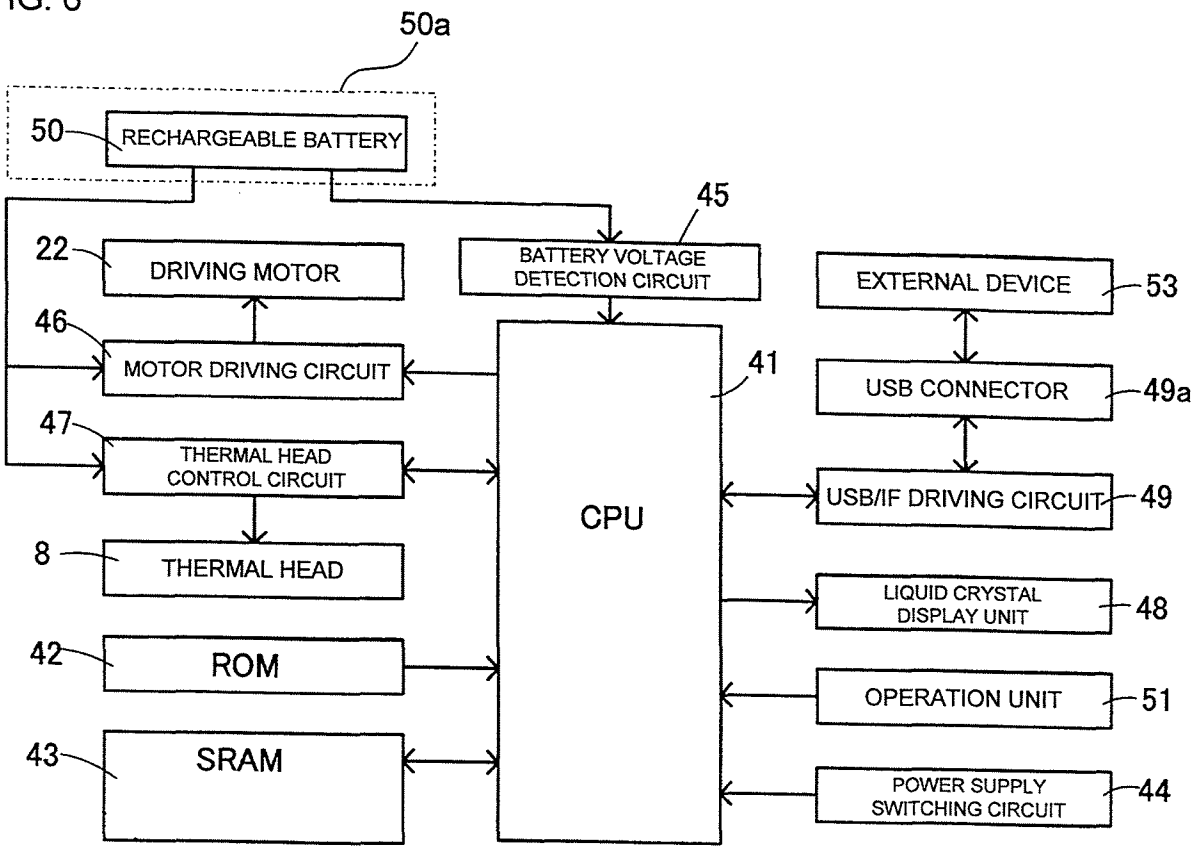
FIG. 6 is a functional block diagram showing the electrical configuration of the handheld compact printer.

FIG. 6 shows the electrical configuration of the handheld compact printer 1. In FIG. 6, the handheld compact printer 1 has a CPU 41. The CPU 41 is connected to a ROM 42, an SRAM 43, a power supply switching circuit 44, a battery voltage detection circuit 45, a motor driving circuit 46, a thermal head control circuit 47, a liquid crystal display portion 48, a USB I/F driving circuit 49 and an operation portion 51.

The driving motor 22 is connected to the motor driving circuit 46 and the thermal head 8 is connected to the thermal head control circuit 47. Each of the motor driving circuit 46 and the thermal head control circuit 47 is supplied with a voltage from a rechargeable battery 50 housed within a battery housing portion 50*a*.

The ROM 42 stores programs for executing various kinds of operations. The SRAM 43 is used as a work area at the time of developing print data. The battery voltage detection circuit 45 detects the voltage of the rechargeable battery 50.

The USB I/F driving circuit 49 is an interface circuit for performing the communication based on the USB standard with an external device 53 which transmits a print signal to the handheld compact printer 1. The external device 53 is connected to the USB I/F driving circuit 49 via a USB connector 49a.

The power supply switching circuit 44 turns on and off the power supply of the handheld compact printer 1. The liquid crystal display portion 48 (also see FIG. 1) is a display means for notifying a user of predetermined information.

<Schematic Operation of Printer>

In the aforesaid configuration, when a print instruction and image data (print data) is sent to the handheld compact printer 1 from the external device 53 such as a personal computer via the USB terminal etc., the driving motor 22 is driven to thereby simultaneously rotate the pickup roller 11 and the platen roller 9. According to the rotation of the pickup roller 11, only the tip of the lowermost one of the laminated thermal papers 4 abuts against the separation block 12. Thus, only the lowermost thermal paper 4 is separated from the laminated thermal papers 4 and transferred to the gap between the lower surface of the separation block 12 and the guide plate 17. Then the thermal paper passes the gap provided between the platen roller 9 and the paper guide 10 and is reversed as described above. The thermal paper 4 thus reversed is transferred toward the thermal head 8 while being sandwiched between the platen roller 9 and the paper guide 10. Then, the thermal head 8 prints desired data on the surface of the thermal paper 4. Thereafter, the thermal paper 4 having been printed is ejected outside of the handheld compact printer 1 from the gap 20 between the fixed cover 3 and the rear surface of the separation block 12.

<Feature of the Embodiment>

In the aforesaid basic configuration, the feature of this embodiment resides in the support structure of the paper guide 10. Hereinafter, the support structure of the paper guide will be explained in detail.

<Comparative Example>

Figure 7:
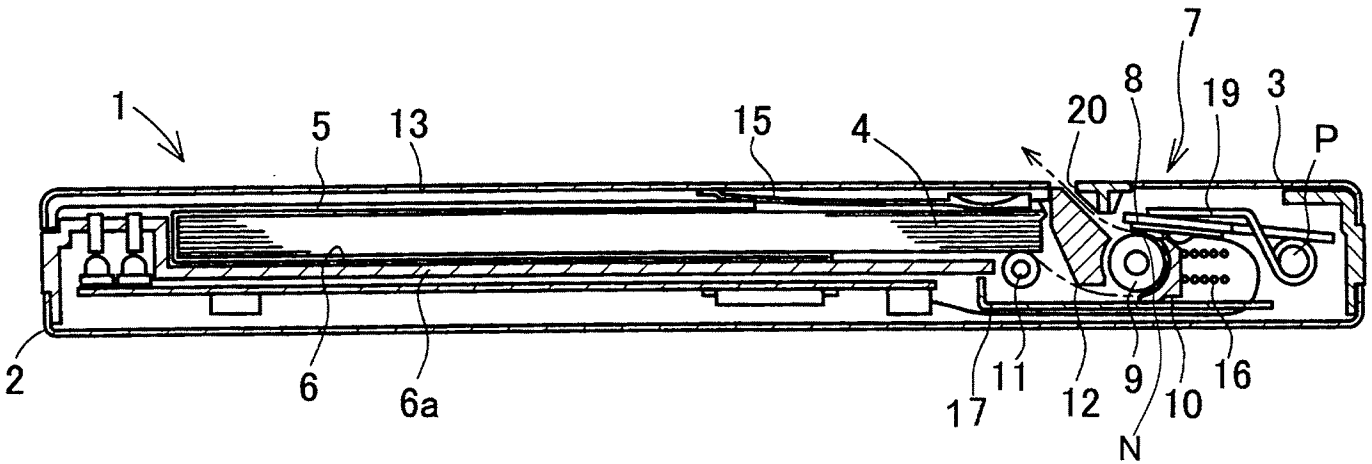
FIG. 7 is a side sectional view showing a comparative example of the handheld compact printer.

A comparative example of this embodiment will be explained with reference to FIG. 7. The comparative example shown in FIG. 7 is configured in a manner that, in order to reliably guide the thermal paper 4 at the time of introducing the thermal paper 4 toward the platen roller 9 and reversing/feeding the thermal paper 4 by the platen roller 9, the paper guide 10 is pressed against the outer peripheral surface of the platen roller 9 and made in contact therewith by the spring pressure of a biasing means 16 such as a pressing coil spring. In this case, since the paper guide 10 in a still state slides on the platen roller 9 being rotated and applies a friction force thereto, this friction force acts as a resistance force for obstructing the rotation of the platen roller 9. As a result, since the platen roller 9 requires a large torque in order to smoothly rotate the platen roller against the resistance force, it was difficult to increase the feeding speed.

<Paper Guide Supporting Structure in this Embodiment>

In view of the aforesaid circumstances, this embodiment is configured in a manner that the paper guide 10 is not made in contact with the outer peripheral surface of the platen roller 9 but a predetermined gap Δ is kept between the paper guide 10 and the outer peripheral surface of the platen roller 9.

Figure 8:
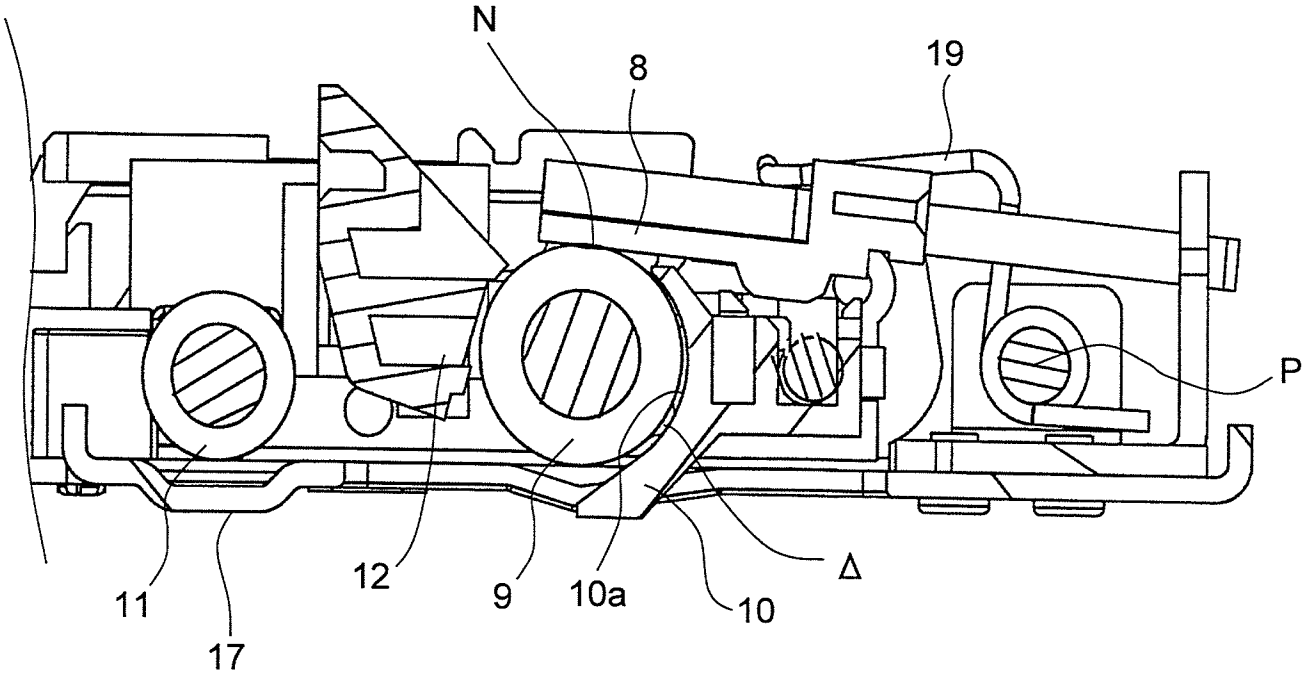
FIG. 8 is an enlarged side sectional view showing a portion A in FIG. 5, which represents the positional relationship between the pickup roller, a platen roller, a paper guide, a separation block and a thermal head.
Figure 9:
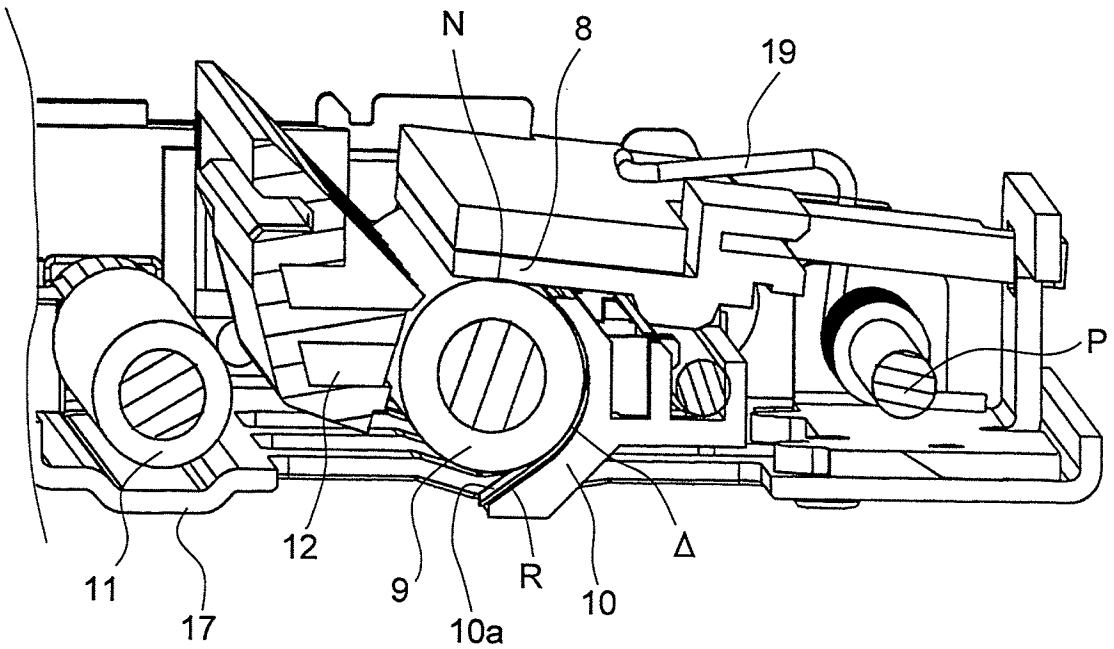
FIG. 9 is a perspective view of the portion A in FIG. 5, which represents the positional relationship between the pickup roller, the platen roller, the paper guide, the separation block and the thermal head.

To be concrete, as shown in FIGS. 8 and 9 illustrating the enlarged structure of a portion A in FIG. 5, this embodiment is configured to keep the gap Δ in a range of about 0.1 mm to about 0.5 mm in the case where the thickness of the thermal paper 4 is 0.09 mm (ream weight of 55 kg), for example. The portion of the gap Δ on the transfer ejection side by the pickup roller 11 (that is, upstream-side portion along the paper feeding path in the entirety of the gap Δ) is formed to be slightly wide (about 0.5 mm, for example) in order to introduce the thermal paper 4 between the paper guide 10 and the outer peripheral surface of the platen roller 9. On the other hand, the portion of the gap Δ on the transfer introducing side approaching to the thermal head 8 (that is, downstream-side portion along the paper feeding path in the entirety of the gap Δ) is formed to be slightly narrow (about 0.1 mm, for example) in order to reliably perform the nipping operation at the printing portion N of the thermal head 8 and to improve the feeding ability.

<Coupling Member>

Figure 10A:
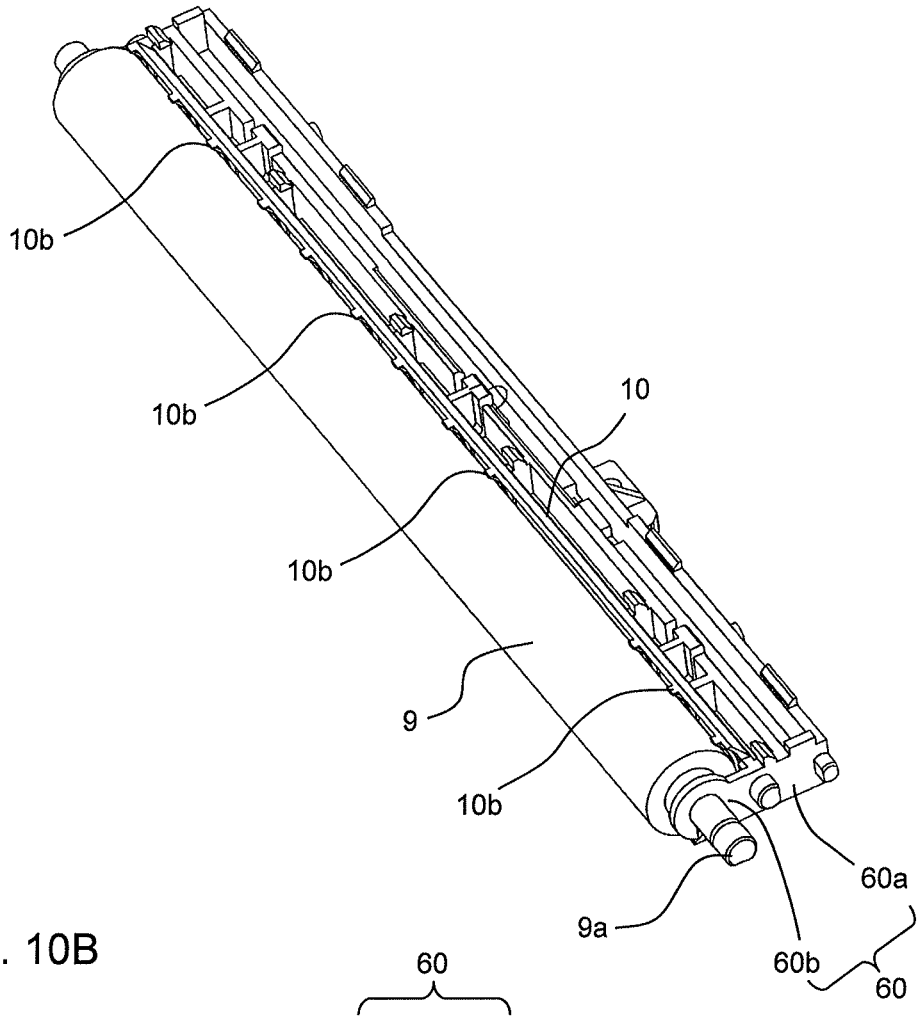
FIG. 10A is a perspective view showing a state that the platen roller is attached to the paper guide via a coupling member.
Figure 10B:
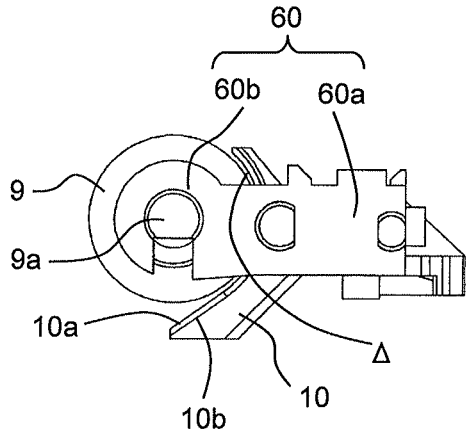
FIG. 10B is a side view showing a state that the platen roller is attached to the paper guide via the coupling member.

The concrete configuration for forming the predetermined gap Δ will be explained with reference to FIGS. 10A and 10B. In this embodiment, as shown in FIGS. 10A and 10B, a coupling member 60 for coupling between the paper guide 10 and the rotation shaft 9*a* of the platen roller 9 is provided. The coupling member 60 includes a shaft holding portion 60*b* having an substantially Ω-shaped opening which is configured to hold the rotation shaft 9*a* of the platen roller 9 while allowing the rotation of the rotation shaft 9*a*, and a (arm shaped) beam portion 60*a* which is configured to be extended toward the first direction side (upper right side in FIG. 10A, right side in FIG. 10B) from the shaft holding portion 60*b* and couple between the shaft holding portion 60*b* and the paper guide 10. When the rotation shaft 9*a* of the platen roller 9 is fit into the shaft holding portion 60*b* from the Ω-shaped opening side (lower side) thereof, the paper guide 10 is attached with respect to the platen roller 9.

Figure 11:
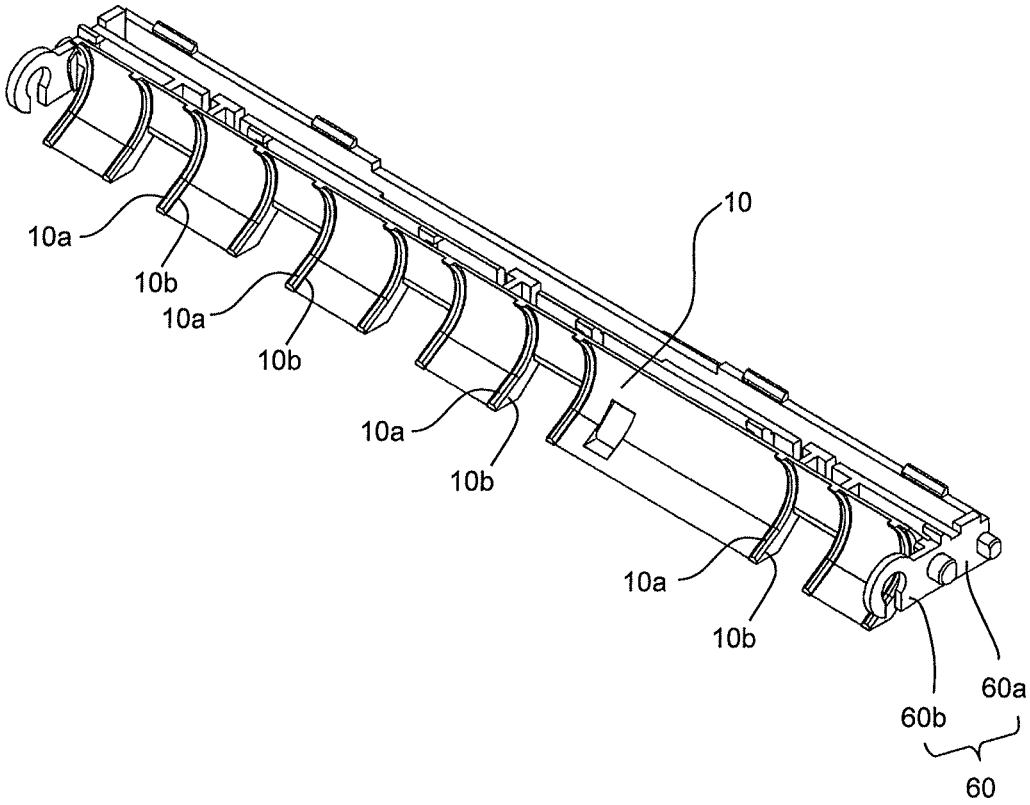
FIG. 11 is a perspective view of the paper guide from which the platen roller is removed.

As shown in FIGS. 10A, 10B and 11, the paper guide 10 has a plurality of (12 in the example of FIG. 11) ribs 10*b* that are provided at the plural portions along the axial direction thereof so as to protrude toward the outer periphery of the platen roller 9. An arc-shaped surface portion 10*a* is formed at the tip of each of the ribs 10*b* in a manner that the center of the curvature of each of the arc-shaped surface portions 10*a* locates at the axis (or in the vicinity thereof) of the rotation shaft 9*a* of the platen roller 9. The arc-shaped surface portions 10*a* oppose to the platen roller 9 along the outer peripheral surface thereof. As shown in FIGS. 8 and 9, the gap Δ is formed by a space between the arc-shaped surface portions 10*a* at the tip ends of the ribs 10*b* and the outer peripheral surface of the platen roller 9.

That is, according to the supporting structure of the paper guide 10 via the coupling member 60, as shown in FIGS. 8 and 9, the thermal head 8 is configured to compress the outer peripheral surface of the platen roller 9 via the thermal paper 4 on the downstream side of the feeding direction of the thermal paper 4 than the gap Δ formed between the arc-shaped surface portions 10*a* and the outer peripheral surface of the platen roller 9. As a result, in this embodiment, the pickup roller 11 acts as a main means for feeding the thermal paper 4 in the aforesaid feeding mode until the thermal paper 4 is nipped by the thermal head 8, whilst the platen roller 9 acts as a main means for feeding the thermal paper 4 after the thermal paper 4 is nipped by the thermal head 8.

As explained above, in the handheld compact printer 1 of this embodiment, the substantially arc-shaped gap Δ is kept by the coupling member 60 between the arc-shaped surface portions 10*a* of the paper guide 10 and the outer peripheral surface of the platen roller 9. At the time of the feeding of the paper, firstly, the pickup roller 11 applies the feeding force to the first direction on the thermal paper 4 to thereby feed the paper to the gap Δ formed between the platen roller 9 and the paper guide 10. Then, the platen roller 9 indirectly applies the feeding force on the portion of the substantially sheet-shaped thermal paper 4 or the portion in the vicinity thereof while the thermal paper 4 proceeds the substantially arc-shaped gap Δ. Thus, the thermal paper 4 can be reliably guided at the time of introducing the paper to the platen roller 9 and at the time of reversing/feeding the paper by the platen roller 9. According to the aforesaid configuration, the friction force generated by the sliding operation between the platen roller 9 and the paper guide 10, in the case where they are made in contact like the prior art, can be prevented from acting as the resistance force for obstructing the rotation of the platen roller 9, by setting the gap Δ to a suitable small value (by suitably setting the length of the beam portion 60*a* of the coupling member, for example). As described above, according to this embodiment, since the resistance force for obstructing the rotation of the platen roller 9 can be reduced while reliably guiding the thermal paper 4, the feeding speed of the paper can be increased.

Further, according to this embodiment, in particular, the shaft holding portion 60*b* of the coupling member 60 holds the rotation shaft 9*a* of the platen roller 9 while allowing the rotation of the rotation shaft 9*a*, and the shaft holding portion 60*b* and the paper guide 10 are coupled by the beam portion 60*a*. Accordingly, the gap Δ can be reliably held between the paper guide 10 and the outer peripheral surface of the platen roller 9.

Further, according to this embodiment, in particular, the paper guide 10 has the plurality of ribs 10*b*. Thus, the contact between the paper guide 10 and the thermal paper 4 is not realized by the surface contact to the entirety of the paper but by the partial contact of the plurality of ribs 10*b*. As a result, since the friction force between the paper guide 10 and the thermal paper 4 can be reduced, the resistance force for obstructing the feeding of the thermal paper 4 due to the friction force of the paper guide 10 can be reduced. Accordingly, the feeding speed of the paper can be further increased.

Further, according to this embodiment, in particular, as explained above, after the thermal paper 4 proceeds into the gap Δ between the platen roller 9 and the paper guide 10 and then passes through the gap Δ, the paper is sandwiched and pressed between the thermal head 8 and the outer peripheral surface of the platen roller 9. That is, while the paper proceeds within the gap Δ, the transfer force of the platen roller 9 merely acts indirectly on the thermal paper 4 as explained above and the pressing force of the thermal head 8 does not act on the paper. As a result, the friction force generated with respect to the thermal paper 4 can be further reliably prevented from acting as the feeding resistance. Accordingly, the feeding speed of the paper can be furthermore increased.

In the aforesaid explanation, arrows shown in FIG. 6 represent an example of the flows of the signals and the flowing directions of the respective signals are not limited thereto.

What is claimed is:

1. A printer comprising:

a main-body case;

a housing portion configured to house substantially sheet-shaped media to be printed as a print object therein, said housing portion being opened on one side of said main-body case;

a pickup roller configured to pick up and feed said medium to be printed toward a first direction along a surface direction of said medium, said pickup roller being disposed in said housing portion;

a platen roller configured to feed said medium to be printed, being fed toward said first direction by said pickup roller, said platen roller being provided on the first direction side than said pickup roller;

a print head configured to perform desired printing on said medium to be printed being fed;

a paper guide configured to reverse, in cooperation with said print head, said medium to be printed being fed toward a second direction in opposite to said first direction while feeding said medium to be printed being fed along an outer peripheral surface of said platen roller, said paper guide including at least one arc-shaped surface portion provided along said outer peripheral surface of said platen roller in an opposed manner thereto; and a coupling member that couples between said paper guide and a rotation shaft of said platen roller so as to keep a predetermined gap between said arc-shaped surface portion of said paper guide and said outer peripheral surface of said platen roller.

2. The printer according to claim 1, wherein:

said coupling member includes:

a shaft holding portion that holds said rotation shaft of said platen roller while allowing rotation of said rotation shaft; and a beam portion that extends toward said first direction from said shaft holding portion and couples between said shaft holding portion and said paper guide.

3. The printer according to claim 1, wherein:

said paper guide includes at least one rib that is disposed on at least one position in an axial direction and protrudes toward said outer peripheral surface of said platen roller than remaining portion of said paper guide, and said arc-shaped surface portion is provided at a tip portion of said at least one rib in a manner that a center of curvature of said arc-shaped surface portion locates at an axis of said rotation shaft of said platen roller or in vicinity of the axis.

4. The printer according to claim 2, wherein:

said print head is configured to compress said outer peripheral surface of said platen roller via said medium to be printed on a downstream side of a feeding direction of said medium to be printed than said gap which is formed between said arc-shaped surface portion and said outer peripheral surface of said platen roller by means of said coupling member.

* * * * *